US005161703A

United States Patent [19]

Patton

[11] Patent Number: 5,161,703

[45] Date of Patent: Nov. 10, 1992

[54] SUPPORT ARRANGEMENT FOR CYLINDRICAL ARTICLES

[75] Inventor: Doyle W. Patton, Crestwood, Ky.

[73] Assignee: Container Corporation of America, Clayton, Mo.

[21] Appl. No.: 677,574

[22] Filed: Mar. 29, 1991

[51] Int. Cl.[5] ..... A47F 7/00

[52] U.S. Cl. ..... 211/294; 211/73; 206/446

[58] Field of Search ..... 211/59.4, 73; 248/174, 248/459; 206/446, 821

[56] References Cited

U.S. PATENT DOCUMENTS

| | | | |
|---|---|---|---|
| 4,195,732 | 4/1980 | Bell | 206/821 X |
| 4,210,202 | 7/1980 | Boyer et al. | 211/59.4 X |
| 4,230,258 | 10/1980 | Lane | 211/73 X |
| 4,901,870 | 2/1990 | Wright et al. | 211/59.4 |
| 5,080,314 | 1/1992 | Moyer et al. | 211/59.4 X |

FOREIGN PATENT DOCUMENTS

| | | | |
|---|---|---|---|
| 86991 | 4/1966 | France | 211/73 |

*Primary Examiner*—Ramon O. Ramirez
*Assistant Examiner*—Sarah A. Lechok
*Attorney, Agent, or Firm*—Richard W. Carpenter

[57] ABSTRACT

A unit for supporting, spacing and cushioning, in cooperation with a plurality of other support units, heavy cylindrical articles arranged in tiers of rows on a pallet or other surface. The unit is formed from foldable sheet material, such as paperboard, and includes top, bottom, side, and end walls that are joined to form an elongated box-like structure with longitudinally space, cushioned, recessed areas for cradling portions of cylindrical articles.

20 Claims, 6 Drawing Sheets

SUPPORT ARRANGEMENT FOR CYLINDRICAL ARTICLES

BACKGROUND OF THE INVENTION

1. Field of the Invention:

This invention relates to arrangements for the storage and shipment of cylindrical articles positioned in horizontal rows and vertical tiers on pallets, and more particularly to improved paperboard support units for spacing, positioning, and supporting cylindrical articles.

2. Description of Background Art:

A background art search directed to the subject matter of this application conducted in the United States Patent and Trademark Office disclosed the following United States Letters Patent:

| | | | |
|---|---|---|---|
| 2,568,769 | 2,845,758 | 2,944,718 | 3,311,232 |
| 4.195,732 | 4,435,463 | 4,444,311 | 4,832,196 |
| 4.901,870 | | and French Patent: | 1,238,112 |

None of the patents uncovered in the search discloses an arrangement, for supporting a plurality of cylindrical articles arranged in tiers of rows, that utilizes a plurality of support units for cushioning, positioning, and supporting the cylindrical articles, wherein the units are each formed from a unitary blank of foldable paperboard and have the unique structures of the support units of the present invention.

SUMMARY OF THE INVENTION

It is an object of the present invention to provide an improved unit for positioning, cushioning, and supporting portions of cylindrical articles stacked in rows and tiers on a pallet for shipping and storage.

A more specific object of the invention is the provision of a support unit of the type described, that can be formed from a unitary blank of foldable paperboard and is adapted to cushion and protect portions of cylindrical articles and also support them safely and efficiently.

These and other objects of the invention will be a apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 2:
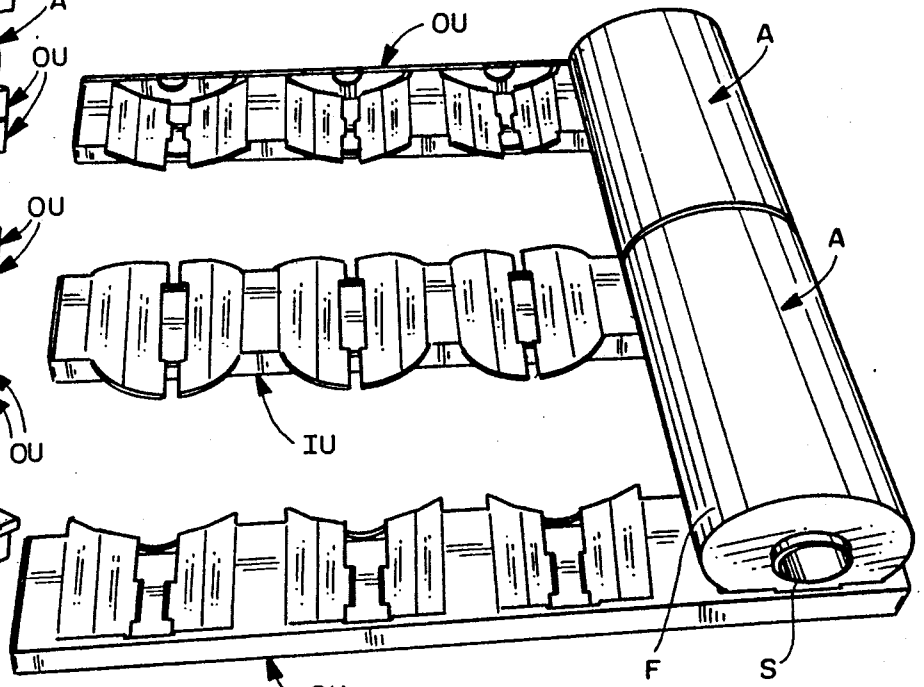
FIG. 2 is a fragmentary perspective view of a portion of one of the tiers of articles illustrated in FIG. 1.
Figure 1:
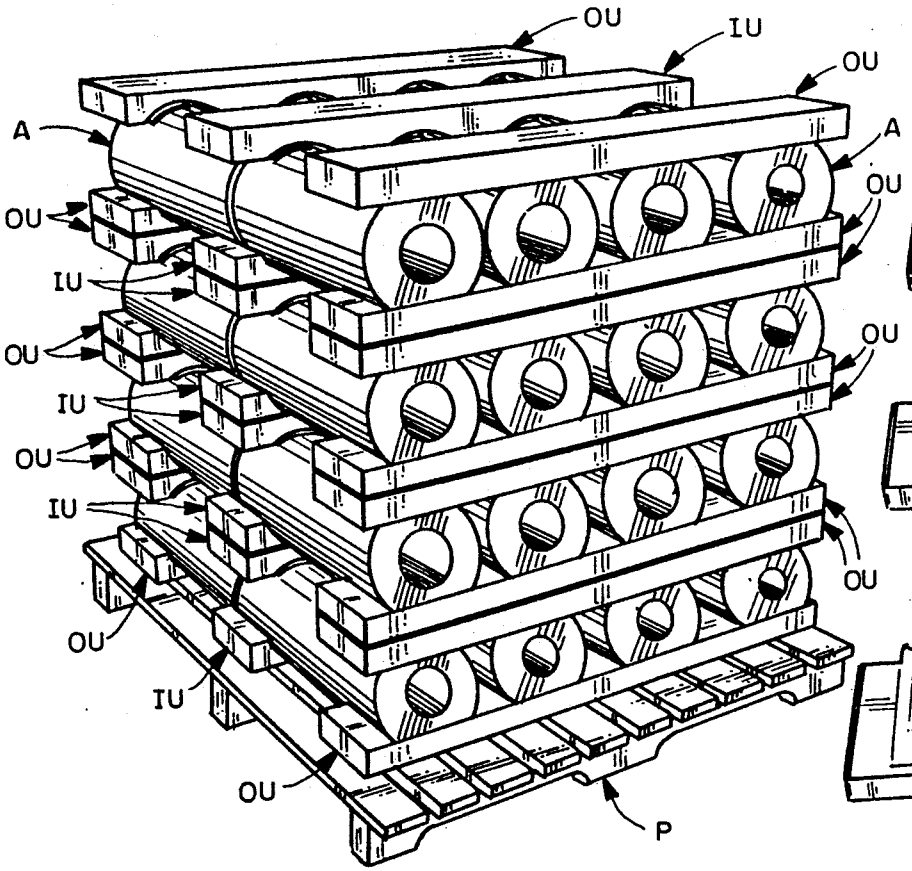
FIG. 1 is a fragmentary perspective view of a pallet load of cylindral articles arranged in tiers of rows and supported by units embodying features of the present invention.
Figure 3:
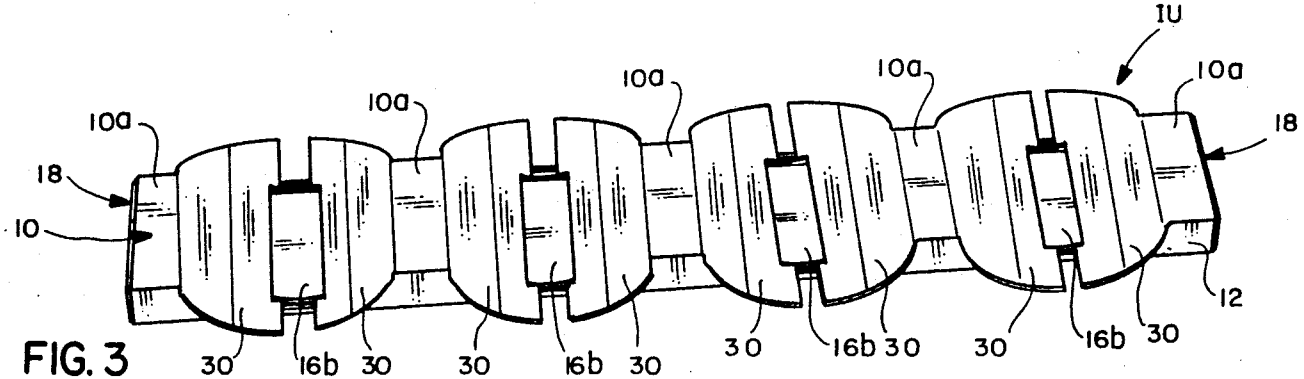
FIG. 3 is a fragmentary perspective view of one type of support unit illustrated in FIGS. 1 and 2.

Referring first to FIGS. 1 and 2 of the drawings, it will be seen that the support units of the present invention are utilized to support a plurality of cylindrical articles A that are arranged on a pallet P in several vertically stacked tiers, with each tier comprising several rows.

The cylindrical articles can be either flat at the ends or, as best seen in FIG. 2, can be in the form of rolled stock such as film sheets F wound around a core or spool S that projects axially beyond the main body of the article.

Still referring to FIGS. 1 and 2, it will be seen that, at each tier of the pallet load, there are provided a plurality of support units for holding the cylindrical articles. It is generally desirable to provide outer or end units having a slightly different contour or configuration than that of the inner or intermediate units, as they have additional functions.

As best seen in FIG. 1, the inner and outer units are used both at the top and bottom of each tier of cylindrical articles, so that in adjacent tiers of articles there are sets of inner and outer units in back to back relation with each other. Therefore, it should be understood that, although the terms top and bottom walls are used in this specification, both the inner and outer units will functions the same way when inverted.

In the present invention, the outer or end units have been designated OU, and the intermediate or inner units have been designated IU. Although the basic structure of the inner and outer units is the same, the outer or end units each have one side wall adapted to engage the ends of the cylindrical articles to retain them in position and prevent them from shifting axially.

Figure 5:
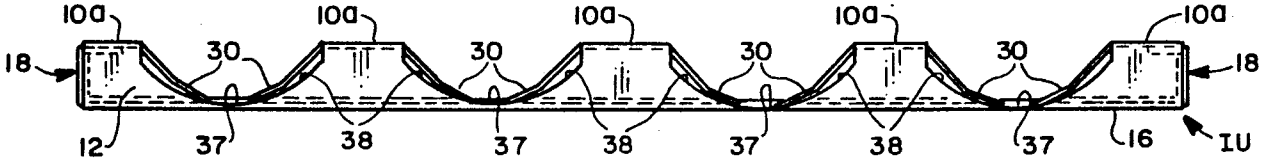
FIG. 5 is a side elevational view of the structure illustrated in FIG. 3.
Figure 6:
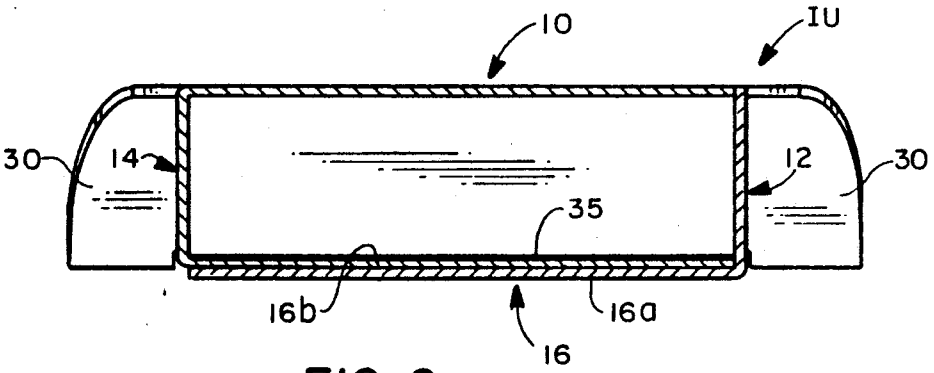
FIG. 6 is a vertical sectional view taken on line 6—6 of FIG. 5.
Figure 7:
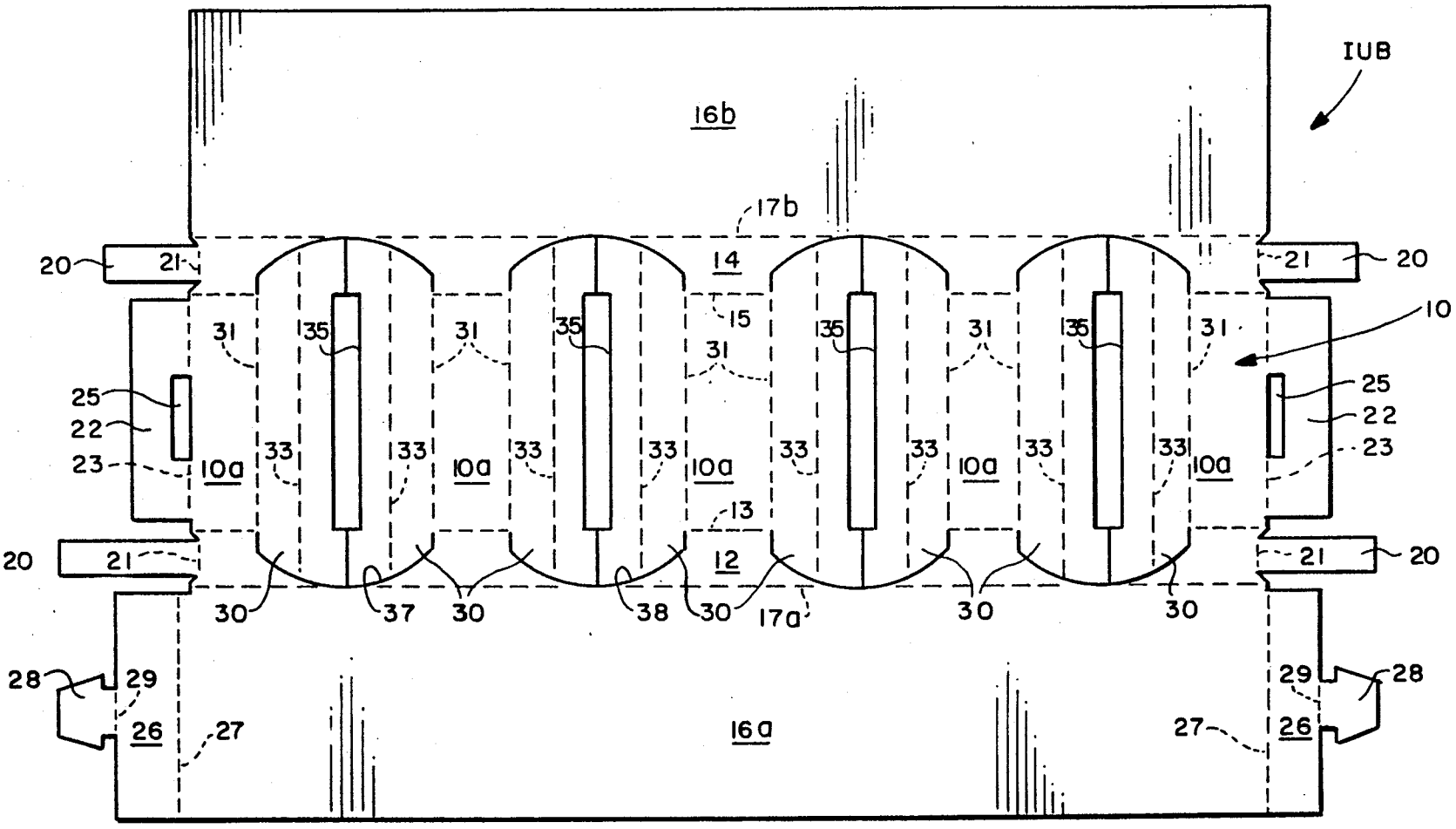
FIG. 7 is a top plan view of a blank of foldable sheet material from which the support unit illustrated in FIGS. 3–6 can be formed.

Now referring to FIGS. 3–7 of the drawings, it will be seen that the inner or intermediate support unit IU, illustrated in FIGS. 3–6, may be formed from the unitary blank IUB of foldable sheet material, such as paperboard, illustrated in FIG. 7.

This unit includes a top wall 10 which is divided into a plurality of top wall sections 10*a* that are spaced longitudinally from each other to provide a plurality of recessed areas 11 therebetween.

A pair of first and second side walls 12 and 14 are foldably joined at their upper edges to opposed side edges of top wall panel 10 along a pair of parallel, interrupted, fold lines 13 and 15, respectively, and are joined at their lower edges to the bottom wall 16.

Bottom wall 16 includess a pair of outer and inner panels 16*a* and 16*b* which are foldably joined to first and second side wall panels 12 and 14 along parallel fold lines 17*a* and 17*b*, respectively. The inner and outer panels are folded together in overlapped relation to provide, with the top and side walls, an elongated box-like structure which is generally rectangular in cross-section, as best illustrated in FIG. 6.

Figure 4:
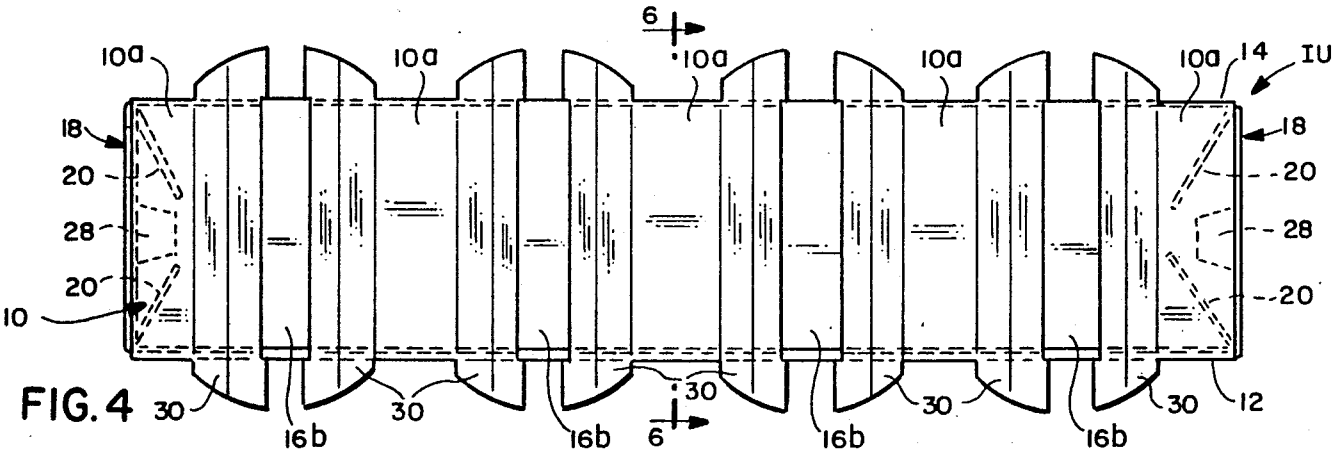
FIG. 4 is a top plan view of the structure illustrated in FIG. 3.

The opposite ends of the structure are closed by composite end walls indicated generally at 18. As best seen in FIGS. 4 and 7, each of the end walls 18 comprises a pair of inner flaps 20, an intermediate flap 22, and an outer flap 26.

Inner flaps 20 are foldably joined to end edges of respective side wall panels 12 and 14 along fold lines 21; intermediate flap 22 is foldably joined to an end edge of top wall panel 10 along fold line 23; and outer flap 26 is foldably joined to an end edge of bottom wall outer panel 16*a* along fold line 27.

It will be noted that outer flap 26 has, foldably joined to its outer edge along fold line 29, a generally arrow-shaped tuck tab 28 adapted to be received within a slot 25 in intermediate flap 22 located immediately adjacent fold line 21.

When the wall end flaps are folded into overlapping relation, as best seen in FIG. 4, the tuck tab 28 can be inserted into opening opening 25 to lock the end wall flaps in position. It can be seen inner end wall flaps 20 tend to angle inwardly to provide additional strength for the structure.

As best seen in FIGS. 5 and 7, in each of the recessed areas 11 a pair of cooperating cushion panels 30 are foldably joined to opposed free edges of adjacent top wall sections 10*a* along fold lines 31.

Each of the cushion panels is provided with an additional fold line 33 to help the panel conform to the curved contour of the cylindrical article when the panel is deflected downwardly, by the pressure of the article, as illustrated in FIG. 5.

Also, opposed edges of each pair of cushion panels are provided with recesses 35 which allow the cushion panel end portions to engage the outer side edges of the bottom wall inner panel 16*b*, as illustrated in FIG. 6.

As best seen in FIGS. 5 and 6, each of the side walls is provided with a plurality of generally arcuate recesses 37, located next to the recessed areas 11 and adapted to receive the cushion panels as they are deflected downwardly. The cushioning panels extend outwardly beyond the side walls, and their end portions are supported by the upwardly facing edge surfaces 38 presented by the side walls in the areas of the recesses.

Thus, it will be understood that, when a cylindrical article is placed on or against a support unit, the cushion panels will be deflected downwardly until they engage the lower panel and the side wall edge surfaces 38 and assume a contour substantially the same as that of the cylindrical article supported.

Figure 12:
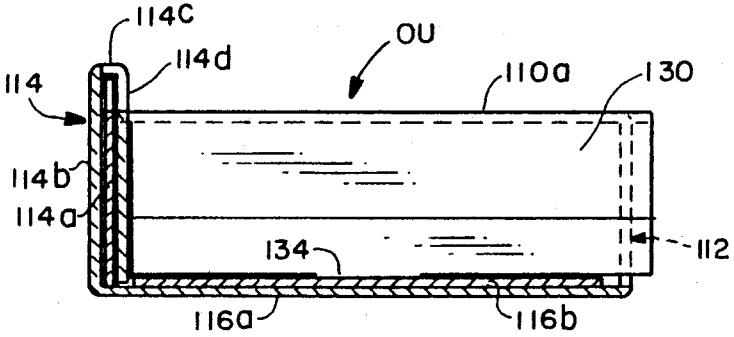
FIGS. 11–13 are vertical sectional views taken on lines 11—11, 12—12, and 13—13 of FIGS. 8, 9, and 10, respectively.
Figure 13:
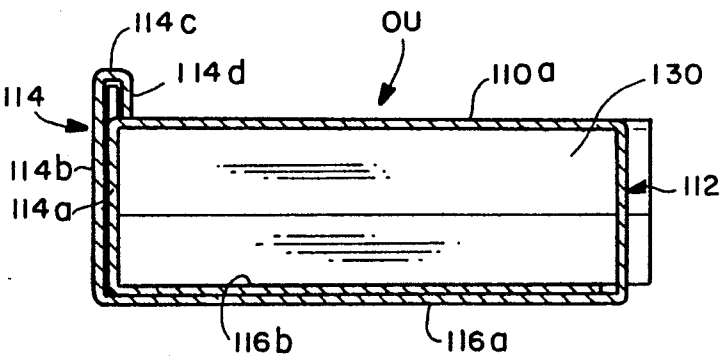
Figure 14:
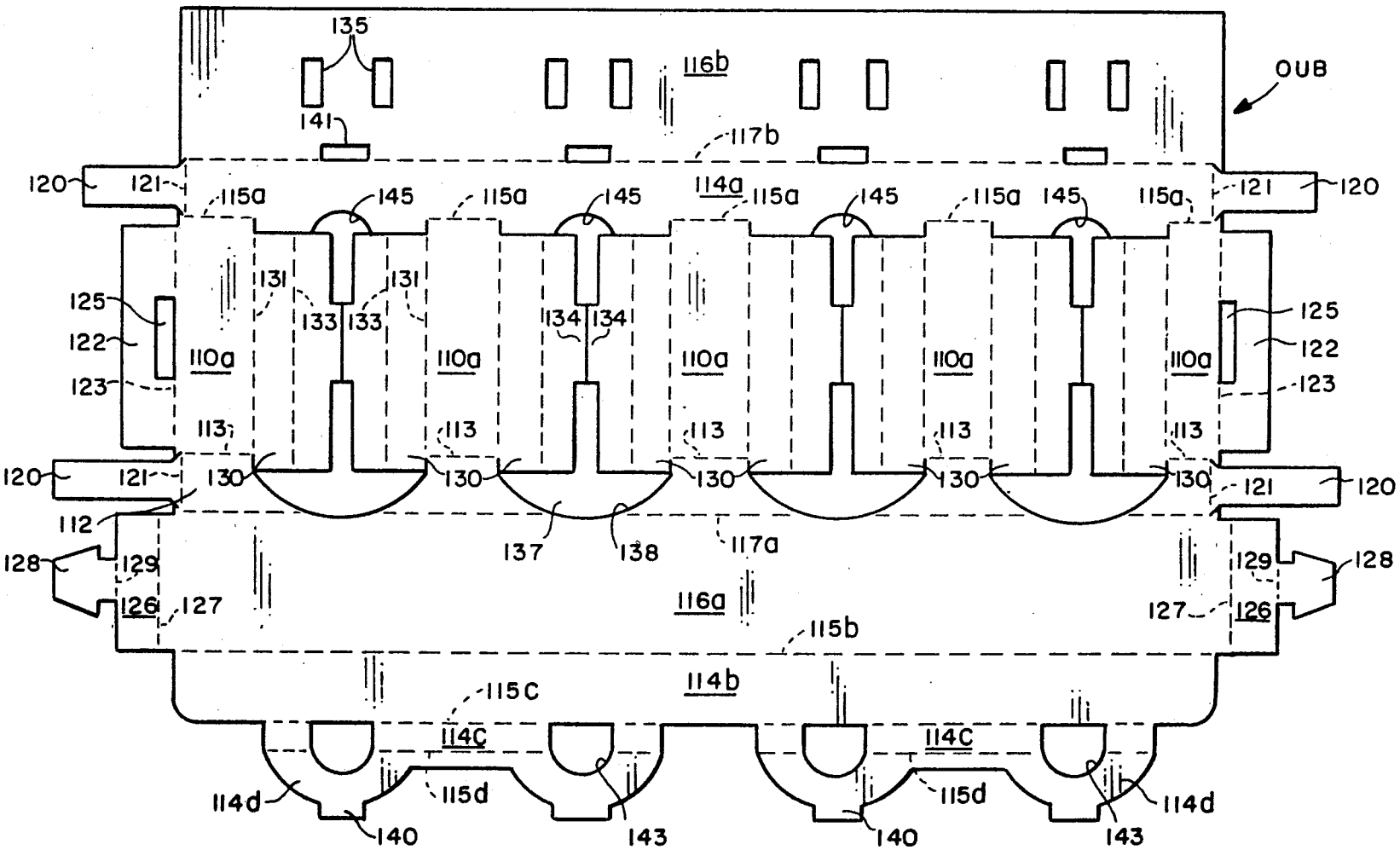
FIG. 14 is a top plan view of a blank of foldable sheet material from which the support unit illustrated in FIGS. 8–13 can be formed.

Now referring to FIGS. 8 through 14 of the drawings, it will be seen that the outer or end support unit OU can be formed from the unitary blank OUB of foldable sheet material illustrated in FIG. 14 of the drawings.

Since the basic structural arrangement of the outer or end unit OU is somewhat similar to that of the inner unit IU, portions of the outer unit structure which correspond to portions of the inner unit structure have been designated by related numerals.

The primary difference between the inner and outer units is that the outer unit is provided with one side wall that is stronger and higher than the other side wall and is adapted to engage ends of cylindrical articles to retain them in position and thereby prevent them from shifting axially.

Figure 8:
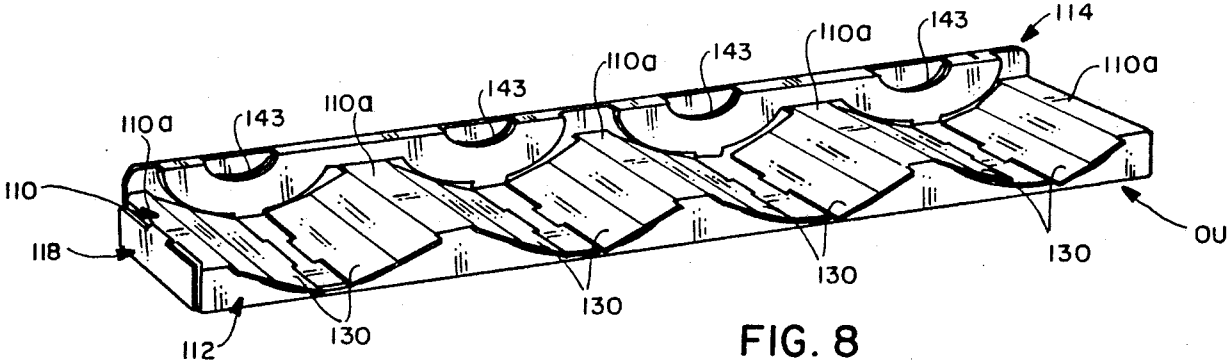
FIGS. 8–10 are views similar to those of FIGS. 3–5, but illustrate another type of support unit shown in FIGS. 1 and 2.
Figure 9:
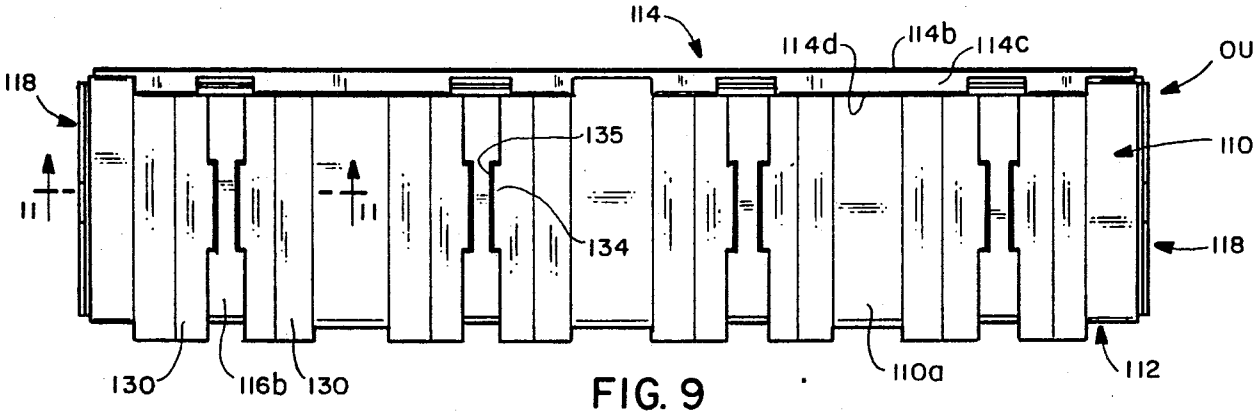
Figure 10:
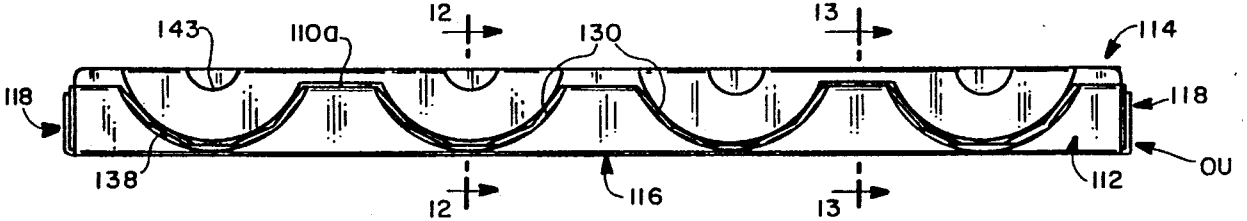

As best seen in FIGS. 8 and 9, outer unit OU includes an elongated top wall 110 comprising a plurality of co-planar, longitudinally spaced, wall sections 110*a* that define recessed areas 111 therebetween.

The outer unit includes a first side wall 112, which is foldably joined along an interrupted fold line 113 to one side of top wall 110, and a second side wall 114, which is of multi-ply construction. Side wall 114 includes an intermediate panel 114*a*, foldably joined along fold line 15*a* to the opposite side of top wall 110; an outer panel 114*b*, foldably joined along fold line 115*b* to a side edge of bottom wall outer panel 116*a*; a top or hinge panel 114*c*, foldably joined along fold line 115*c* to outer panel 114*b*; and an inner panel 114*d*, foldably joined along fold line 115*d* to another side edge of hinge panel 114*c*.

The structure of bottom wall 116 is similar to that of the inner unit and includes an outer panel 116*a*, foldably joined along fold line 117*a* to a lower edge of first side wall panel 112, and an inner panel 116*b*, foldably joined along fold line 117*b* to a lower edge of second side wall intermediate panel 114*a*.

The structure of each end wall 118 is substantially the same as that of the inner unit end walls and includes a pair of inner flaps 120, foldably joined along fold lines 121 to the end edges of respective side wall panels; an intermediate flap 122, foldably joined along fold line 123 to an end edge of top wall 110; and an outer panel 126, foldably joined along a fold line 127 to an end edge of bottom wall outer panel 116*a*.

Outer flap 126 includes a tuck tab 128 foldably joined to the main portion on fold line 129 and adapted to be received within intermediate end wall flap slot 125.

The outer or end unit is also provided with cushion panels 130 in the recessed areas 111 which are arranged in pairs and foldably joined to opposed edges of top wall sections 110*a* along fold lines 131. Cushion panels 130 also have additional fold lines 133 to help them conform to the contour of the supported cylindrical articles.

Cushion panels 130 are also provided with extended central portions 134 which form lock tabs adapted to be received within related slots 135 in the bottom wall inner panel to help maintain the cushion panels in position.

Unlike the structure of the inner unit, only first side wall 112, is provided with arcuate longitudinally spaced recesses 137 that present recess upper edge surfaces 138 adapted to receive support portions of the cushion panels 130 in the same manner as in the case of the inner support unit.

As best seen in FIG. 14, the second side wall inner flaps 114*d* are provided with downwardly extending projections that form lock tabs 140 adapted to be received in slots 141 in the bottom wall inner panel 16*b* in a manner hereinafter described.

It will be seen that the second side wall hinge panel 114*c* and the second side wall inner panel 114*d* are provided with a plurality of communicating openings 143, portions of which are curved. These curved portions coincide with the curved recesses 145 in second side wall intermediate panel 114*a* when the structure is erected, and their purpose is described later in the specification.

In order to erect the outer unit from the blank, the top, side, and bottom wall panels are folded at right angles to each other to form a tubular structure having a rectangular cross-section, as illustrated in FIGS. 12 and 13.

The bottom wall inner panel is positioned on the bottom wall outer panel, and the second side wall intermediate panel is sandwiched between the second side wall outer and inner panels and locked in position by the insertion of the second side wall inner panel lock tabs 140 into bottom wall inner panel slots 141. Closing and locking of the end wall flaps is done in the same way as are the end wall flaps of the inner unit.

Figure 11:
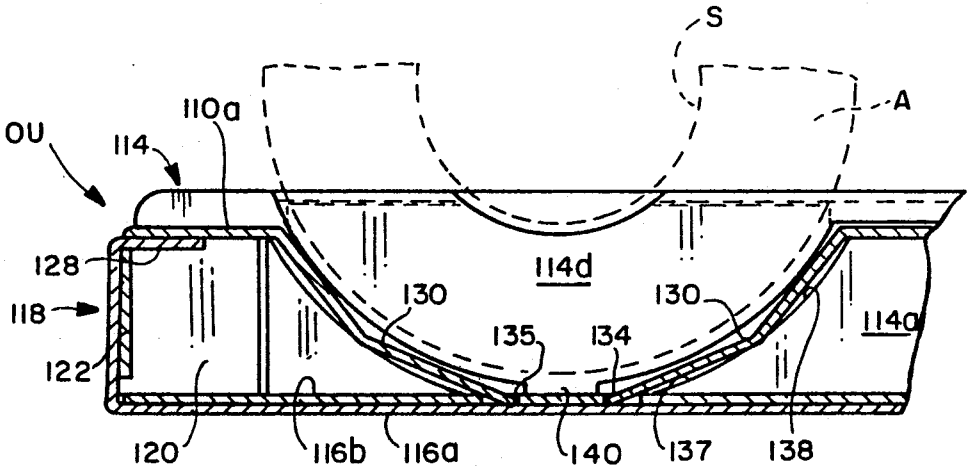

As previously mentioned, the second side wall extends above the top wall to provide a greater surface area for engaging the end of a cylindrical object to prevent it from moving axially. Also, the recesses 143 in the second side wall hinge and inner panels, as well as the recess 145 in the second side wall intermediate panel, cooperate to provide a common recess adapted to support a core type portion of a cylindrical article, such as a spool S, as illustrated in FIG. 11.

Thus, it will be appreciated that the invention provides a unique arrangement for supporting a plurality of heavy cylindrical articles in tiers of rows on a pallet by the use of relatively inexpensive paperboard units that are designed and arranged to give maximum strength and protection.

What is claimed is:

1. A support unit for spacing, cushioning, and supporting, in cooperation with a plurality of other support units, heavy cylindrical articles arranged in tiers of rows on a pallet or other surface, said unit being formed from a unitary blank of foldable sheet material, such as paperboard, and comprising:

(a) a bottom wall;

(b) a pair of opposed side walls foldably joined to and upstanding from opposed sides of said bottom wall;

(c) a top wall foldably joined to and extending between said side walls;

(d) at least one of said side walls having, at longitudinally spaced intervals, recesses therein, each of which is defined by a pair of upper edge surfaces sloping downwardly toward each other and toward said bottom wall;

(e) said top wall including a plurality of co-planar, longitudinally spaced sections defining therebetween recessed areas adapted to receive portions of heavy cylindrical articles;

(f) pairs of cushion panels at each of said recessed areas, the panels of each pair being foldably joined to opposed edges of adjacent top wall sections and extending toward each other;

(g) said cushioning panels being arranged and disposed to be deflected toward said bottom wall by the pressure of cylindrical articles being applied thereagainst and having end portions extending beyond said one side wall and being supported thereby.

2. A support unit for spacing, cushioning, and supporting, in cooperation with a plurality of other support units, cylindrical articles arranged in tiers of rows on a pallet or other surface, said unit being formed from a unitary blank of foldable sheet material, such as paperboard, and comprising:

(a) a bottom wall;

(b) a pair of opposed side walls foldably joined to and upstanding from opposed sides of said bottom wall;

(c) a top wall foldably joined to and extending between said side walls;

(d) a pair of opposed end walls foldably joined to said top, bottom, and side walls;

(e) at least one of said side walls having at longitudinally spaced intervals, recesses therein, each of which is defined by a pair of upper edge surfaces sloping downwardly toward each other and toward said bottom wall;

(f) said top wall including a plurality of co-planar, longitudinally spaced sections defining therebetween recessed areas adapted to receive portions of heavy cylindrical articles;

(g) pairs of cushion panels at each of said recessed areas, the panels of each pair being foldably joined to opposed edges of adjacent top wall sections and extending toward each other;

(h) said cushion panels being arranged and disposed to be deflected toward said bottom wall by the pressure of cylindrical articles being applied thereagainst and having end portions extending beyond said one side wall and being supported thereby.

3. A support unit for spacing, cushioning, and supporting, in cooperation with a plurality of other support units, cylindrical articles arranged in tiers of rows on a pallet or other surface, said unit being formed from a unitary blank of foldable sheet material, such as paperboard, and comprising:

(a) a bottom wall;

(b) a pair of opposed first and second side walls foldably joined to and upstanding from opposed sides of said bottom wall;

(c) a top wall foldably joined to and extending between said side walls;

(d) said first side wall having, at longitudinally spaced intervals, recesses therein, each of which is defined by a pair of upper edge surfaces sloping downwardly toward each other and toward said bottom wall;

(e) said top wall including a plurality of co-planer, longitudinally spaced sections defining therebetween recessed areas adapted to receive portions of heavy cylindrical articles;

(f) pairs of cushion panels at each of said recessed areas, the panels of each pair being foldably joined to opposed edges of adjacent top wall sections and extending toward each other;

(g) said cushion panels being arranged and disposed to be deflected toward said bottom wall by the pressure of cylindrical articles being applied thereagainst and having end portions extending beyond said one side wall and being supported thereby;

(h) said second side wall being arranged to close corresponding ends of said recessed areas to retain end portions of cylindrical articles therein.

4. a support unit according to claim 1, wherein another of said side walls is arranged and disposed to close corresponding ends of said recessed areas and retain portions of cylindrical aricles therein.

5. A support unit according to claim 2, wherein another of said side walls is arranged and disposed to close corresponding ends of said recessed areas and retain portions of cylindrical articles therein.

6. A support unit according to claim 4, wherein said other side wall extends above said top wall and includes recesses adapted to support and position outwardly projecting central portions of cylindrical articles.

7. A support unit according to claim 5, wherein said other side wall extends above said top wall and includes recesses adapted to support and position outwardly projecting central portions of cylindrical articles.

8. A support unit according to claim 3, wherein said second side wall extends above said top wall and includes recesses adapted to support and position outwardly projecting central portions of cylindrical articles.

9. A support unit according to claim 1, wherein said bottom wall includes a pair of inner and outer panels and wherein said cushioning panels have interlocking engagement with said inner panels.

10. A support unit according to claim 2, wherein said bottom wall includes a pair of inner and outer panels and wherein said cushioning panels have interlocking engagement with said inner panels.

11. A support unit according to claim 3, wherein said bottom wall includes a pair of inner and outer panels and wherein said cushioning panels have interlocking engagement with said inner panels.

12. A support unit according to claim 1, wherein both of said side walls have recesses and wherein said cushioning panels extende outboardly through said recesses beyond both of said side walls.

13. A support unit according to claim 2, wherein both of said side walls have recesses and wherein said cushioning panels extend outboardly through said recesses beyond both of said side walls.

14. A support unit according to claim 1, including end walls each comprising:

(a) a pair of inner flaps foldably joined to ends of respective side walls;

(b) an intermediate flap foldably joined to an end of one of said top and bottom walls and having a tab receiving opening therein adjacent said one wall;

(c) an outer flap foldably joined to an end of the other of said walls and having a tuck tab receivable in said opening to lock said end wall flaps in place.

15. A support unit according to claim 2, including end walls each comprising (a) a pair of inner flaps foldably joined to ends of respective side walls;

(b) an intermediate flap foldably joined to an end of one of said top and bottom walls and having a tab receiving opening therein adjacent said one wall;

(c) an outer flap foldably joined to an end of the other of said walls and having a tuck tab receivable in said opening to lock said end wall flaps in place.

16. A support unit according to claim 3, including end walls each comprising:

(a) a pair of inner flaps foldably joined to ends of respective side walls;

(b) an intermediate flap foldably joined to an end of one of said top and bottom walls and having a tab receiving opening therein adjacent said one wall;

(c) an outer flap foldably joined to an end of the other of said walls and having a tuck tab receivable in said opening to lock said end wall flaps in place.

17. A support unit according to claim 1, wherein said other side walls includes a plurality of panels, certain of which have recesses arranged and disposed to support and position outboardily projecting central portions of cylindrical articles.

18. A support unit according to claim 2, wherein said other side walls includes a plurality of panels, certain of which have recesses arranged and disposed to support and position outboardily projecting central portions of cylindrical articles.

19. A support unit according to claim 3, wherein said second side wall includes a plurality of panels, certain of which have recesses arranged and disposed to support and position outboardly projecting central portions of cylindrical articles.

20. A support unit according to claim 3, wherein said second side wall includes:

(a) an outer panel foldably joined to an outer panel of said bottom wall;

(b) an inner panel;

(c) an intermediate panel foldably joined at its upper end to said top wall and foldably joined at its lower end to an inner panel of said bottom wall and being interposed between said side wall inner and outer panels.

* * * * *